United States Patent [19]

Robinson et al.

[11] Patent Number: 4,887,772

[45] Date of Patent: Dec. 19, 1989

[54] CASSETTE KNIFE FOR CHIPPER

[75] Inventors: Mark D. Robinson, Black River; Eugene A. Farrell, Fishers Landing, both of N.Y.

[73] Assignee: Carthage Machine Co., Div. of Industrial General Corp., Carthage, N.Y.

[21] Appl. No.: 310,054

[22] Filed: Feb. 10, 1989

[51] Int. Cl.[4] ..... B02C 18/18

[52] U.S. Cl. ..... 241/92; 144/176; 241/298

[58] Field of Search ..... 144/176, 241, 230; 241/296, 298, 92, 300

[56] References Cited

U.S. PATENT DOCUMENTS 4,694,995 9/1987 Holmberg et al. ..... 241/92

4,784,337 11/1988 Nettles et al. ..... 144/241 X

*Primary Examiner*—Mark Rosenbaum

*Attorney, Agent, or Firm*—Wall and Roehrig

[57] ABSTRACT

A knife assembly for a wood chipper has a cassette, a top blade holder, and a trapezoidal cross-section double-edge blade. The cassette is of profiled cross-section, with a full-width proximal section, a stepped-down blade holder support surface on an intermediate section, and a blade support surface on a distal or tip section. A proximally and downward sloping surface extends from a distal edge of the blade holder support surface to the blade support surface. The blade has substantially flat upper and lower surfaces so as to avoid structure which is susceptible to snapping or splitting under the stresses normally encountered in a chipping operation. One edge of the trapezoidal blade is exposed and extends forward of the cassette and the blade holder. The tapered ground surface that defines the concealed edge of the blade faces against the sloping surface of the cassette. Molten babbitt is poured through openings in the blade holder to form babbitt shims filling the space between the concealed blade sloping surface and the sloping surface of the cassette. Thus, the blade is supported both from beneath and at the concealed ground or tapered surface. Further, the babbitting provision permits precise positioning and adjustment of knife projection.

12 Claims, 6 Drawing Sheets

CASSETTE KNIFE FOR CHIPPER

BACKGROUND OF THE INVENTION

The present invention relates to knife assemblies for disk-type chippers, and in particular to an improved cassette knife assembly employing reversible blades.

Chippers of this type are well known, and one example is described in U.S. Pat. No. 4,784,337 to Nettles et al. The chipper there described is of the well-known Carthage-Norman design in which a vertical disk rotates upon a horizontal drive shaft. The disc is covered by a housing with a removable head, and a spout or feeder projects from the housing for guiding logs. The logs are supplied, generally end-on, to a series of radially disposed knives carried on the disk. The knives are clamped in place at cutting stations around the disk and chip slots or passages through the disk are situated at the cutting stations adjacent the knife blades. The wood chips cut from the logs move through the passage and are ejected from the machine via a casing discharge area. The spout or feeder has a stationary bedknife that cooperates with the rotary knives so that the logs are cut into uniform chips suitable to be supplied, e.g., to a digester of a wood pulping process.

The blades of the knife assemblies are the parts of the chipper most subject to wear. Ideally, the blades should be easy to replace and to adjust accurately. Material is ground off the blades by resharpening them, and adjustment is required when there is a need to change chip size, so the blades should be adjustable and firmly supported in the adjusted positions.

Reversible knives are often employed as a step in reducing machine down time and knife cost. A number of reversible-blade arrangements have been described, e.g., in Carpenter et al. U.S. Pat. No. 4,669,516 and in Svensson U.S. Pat. No. 4,047,670. Each of these has a knife blade of bent cross section. Carpenter et al. employs a V-shaped knife, and Svensson a Z-shaped knife. These each have angularly disposed cutting surfaces that make the blade extremely difficult to grip and support during assembly. The knives are clamped down by means of a clamp bar or hold down plate. The latter must be rather precisely machined to accept the complex shape of the knife blade. Due to the odd configuration, these blades are expensive to manufacture, and rather difficult to sharpen. The center waist or bend represents a weak sector, but is also the place of maximum mechanical stress. Thus, these blades are subject to an accelerated rate of failure under load. Consequently, both the initial cost of a chipper using these reversible knives and their cost of maintenance and operation remain relatively high.

In a disposable knife system, the conventional resharpenable chipper knife is replaced with an adapter or cassette and knife assembly. This can be comprised of a two-piece knife blade, a cassette, and a top hold-down plate. One such device is disclosed in U.S. Pat. No. 4,784,337. In this system a reversible, double-edge knife blade fits an elongated cassette that has a blade-receiving recess formed on it. The knife has a cutout on its underside which fits a rib or key on the cassette. The knife is held in place by fasteners, a retaining bar, or the like, so that it covers one edge, so that the other edge of the knife is accurately positioned at the entrance to a chip slot. Adjustment of blade position is effected by forming babbitt pads at the back or proximal end surface of the cassette.

The cutouts at the underside of the blades can have a weakening effect, unnecessarily leading to fracturing of the blades during a chipping operation. However, with the system of this patent, it is not possible to employ a keyless, flat blade.

Thus, present day log chippers can be provided with either large, single-edge knives or smaller, double-edge reversible knives. The large single-edge knives can be reground and replaced in the disk by babbitting, shimming, or otherwise adjusting the width dimension to be considered full width for use in the chipper disk clamping arrangement.

The smaller, double-edge blades now available require a unique profile which is critical to their clampability; this profile can be a key, groove, waist, etc. This structure can create a weak point that may fracture in service.

An ideal chipper knife should have a double-edge, reversible knife that can be discarded or resharpened, and which has flat upper and lower surfaces, i.e., without waists, bends, etc., so as to avoid fracturing. The knife should also be susceptible to dimensional adjustment, e.g., by babbitting or shimming, to place its non-exposed ground face into firm bearing contact with respect to a supporting land or surface in the associated cassette or holder. However, no such knife or knife assembly has been previously proposed.

OBJECTS AND SUMMARY OF THE INVENTION

Accordingly, it is an object of this invention to provide a simple yet effective cassette-type knife assembly for chippers, and which avoids the drawbacks of the prior art.

It is another object of this invention to provide a chipper blade assembly which employs a small double-edge reversible blade that is of simple cross section and less subject to fracture in operation.

It is still another object of this invention to provide a blade assembly in which positioning of the blade in the cassette or holder can be adjusted and in which the non-exposed blade surface is in bearing or supporting contact with a corresponding surface of the cassette or holder.

It is yet a further object of this invention to provide a cassette-type knife assembly which employs a reversible blade that is supported both behind and beneath, and which can thus be adapted into disk chippers and the like that were originally designed for single-edge regrindable knives.

According to an aspect of this invention, the chipper knife blade assembly has at least one flat, double-edge knife blade of generally non-rectangular quadrilateral (i.e., trapezoidal or parallelogram) cross section, with a flat base surface, a flat top surface, and first and second tapered sides that slope downward from the top surface to the base to define first and second cutting edges. To accommodate this blade, the cassette is of a stepped arrangement, with a full thickness proximal section, a recessed intermediate section, and a possibly further recessed proximal section. A flat lower surface extends for the proximal, intermediate, and distal sections. The proximal section has a flat upper surface spaced by the full cassette width from the lower surface. The intermediate section has a blade holder support surface that is recessed below the upper surface a sufficient amount to accommodate a blade holder to be described shortly. This blade extends from a shoulder, at the juncture with the proximal section, to a distal edge of the blade holder support surface. There, a tapered surface slopes downwards from the distal edge of the blade holder support surface to a blade support surface on the distal section. This blade support surface serves to support the base surface of the trapezoidal or parallelogram knife blade and extends from the tapered surface distally to a distal edge of the cassette. There, a wear surface slopes proximally down to the cassette lower surface. The blade is positioned on the cassette with its base surface against the knife blade support surface and with a proximal one of the two ground or tapered surfaces facing against the cassette tapered surface. The other or distal cutting edge of the blade projects beyond the distal edge of the cassette. A blade holder is in the form of a laterally elongated plate having a breadth sufficient to extend over the blade holder support surface from the shoulder to and over the top surface of the blade to a point just short of the exposed sloping surface. Preferably, this blade holder has a tapered distal edge which will remain proximally of the plane of the blade's exposed tapered surface, so that the holder is not subjected to contact with the feed logs being supplied into the chipper.

The blade holder is preferably clamped down by threaded fasteners, e.g., machine screws, which mate into threaded openings in the cassette blade holder support surface. The holder sandwiches the blade between itself and the cassette. There are a series of openings along the blade holder at the position of the top of the cassette tapered surface. Through these openings, molten babbitt is flowed to form a firm shim or spacer against the concealed tapered surface of the blade and the facing cassette tapered surface.

A short section of the blade lower base surface near each edge can be reground one or more times without affecting the plane of the blade primary tapered surface. This is significant insofar as any changes in spacing between the blade edges and plane of the tapered surface on the one hand, from the bedknife, on the other hand, can affect chip quality.

By "babbitt" is meant not only the traditional alloys of copper, zinc, and antimony, but also, other shim materials that may be suitable for that purpose.

The cassettes, blades and holders can be assembled and adjusted in a standard knife mold or jig so that the free edge of the knife blade is properly positioned for the desired chip size. After the blade holder has been fastened down with the machine screws, the babbitt shims can be formed by flowing the babbitt into the openings in the blade holder.

Additional apertures are formed along the proximal edge of the cassette, and babbitt shims can be formed on the cassette to adjust the cassette position in the disk.

The above and many other objects, features, and advantages of this invention will be more fully understood from the ensuing description of a preferred embodiment, which should be read in connection with the accompanying drawing.

DETAILED DESCRIPTION OF THE PREFERRED EMBODIMENT

Figure 2:
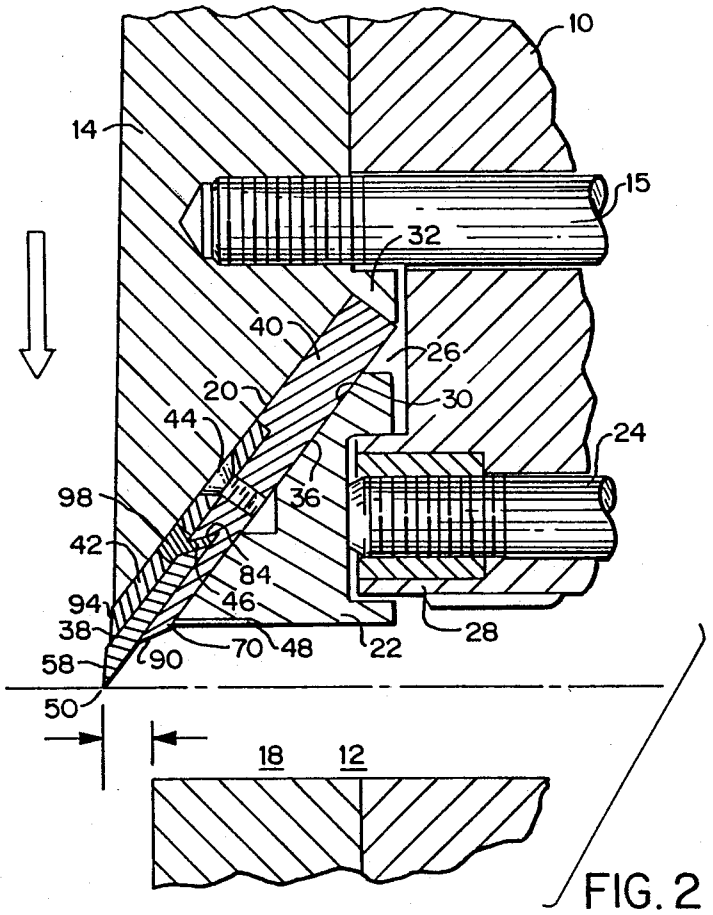
FIG. 2 is a sectional view of a portion of a chipper disk, showing a knife assembly according to one embodiment of this invention installed adjacent a chip slot therein.
Figure 1:
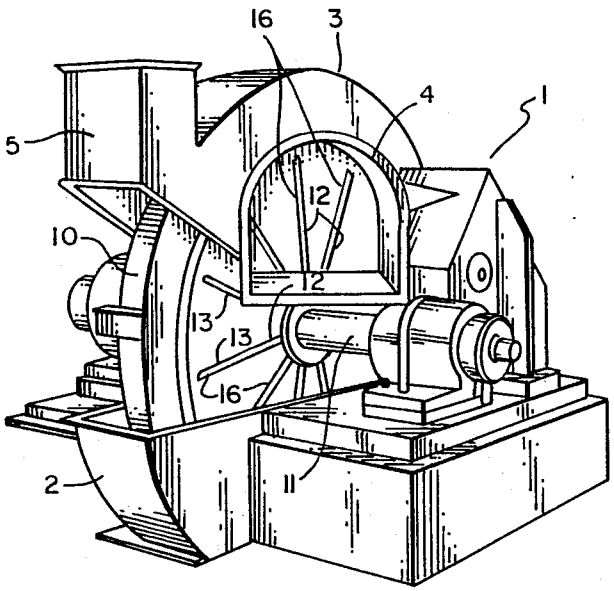
FIG. 1 is a perspective view of a chipper which employs the knife assemblies according to an embodiment of this invention.

Referring to the Drawing, and initially to FIGS. 1 and 2, a large, vertical-disk type log chipper 1 can be of the wellknown Carthage-Norman design, as described, e.g., in U.S. Pat. No. 4,784,337. The chipper 1 has a lower enclosure to and a hood 3 which contains a spout or log chute 4 as well as an exhaust chute 5. A portion of the enclosure has been removed, to make visible a portion of the large rotary disk 10 of the machine. The disk 10 is motor driven with an axle 11 disposed below the spout 4. Distributed around the disk 10 are between three and fifteen more-or-less radially extending chip slots 12 that pass through the disk 10. Each chip slot defines a cutting station 13. The disk 10 rotates in the direction shown by arrows in FIGS. 1 and 2.

As illustrated in FIG. 1, at each of the cutting stations 13 there is a fixed knife holder 14 that is secured to the vertical front face of the disk 10 by means of threaded members 15, such as bolts or studs. A knife assembly 16, to be described in greater detail later, is mounted at an angle of about thirty to forty-five degrees adjacent to the associated chip slot at an entrance 18 to the chip slot 12. The knife holder 14 has a sloping upper clamping surface 20 which contacts the top surface of the knife assembly 16. A clamping member 22 is adjustably supported on the disk 10 by means of bolts 24 or other threaded support members, and fits into a recess 26 in the disk 10. The clamping member 22 is positioned by a shoulder 28 along the rim of the chip slot 12. A sloping face 30 of the clamping member 22, together with a heal 32 of the stationary knife holder 14 and the upper clamping surface 20 thereof define a knife slot 36 into which the knife assembly 16 is disposed.

As shown in FIG. 2, with further reference to FIGS. 3–6, the knife assembly 16 is of the cassette type, with a disposable reversible blade. The assembly 16 comprises one or more elongated blades 38 situated in a cassette or support member 40, here shown in cross section as a stepped unitary block. A blade holder 42 holds the blades 38 to the cassette 40 and is fastened by means of machine screws 44 to the cassette 40. Babbitt pads or shims 46 support the knife blades 38 within the assembly 16 by supporting an unexposed ground edge of each of the knife blades 38.

There is a wear resistant facing 48 within the entrance to the chip slot 12 on the clamping member 22. Also, there is a stainless steel liner downstream of the chip slot 12 to reduce wear on the disk 10 from contact with the fast-moving wood chips.

A free or projecting edge 50 of the knife blade 38 extends axially forward of the leading edge of the chip slot 12 by a predetermined distance Y. This distance is adjusted according to the desired chip size. Also, the edge 50 should project at least several mils forward of the surface of the upper clamping member 14. However, the position of the projecting cutting edge 50 of the knife blade 38 should also be carefully positioned so as not to contact the bedknife (not shown) during a cutting operation.

Figure 3:
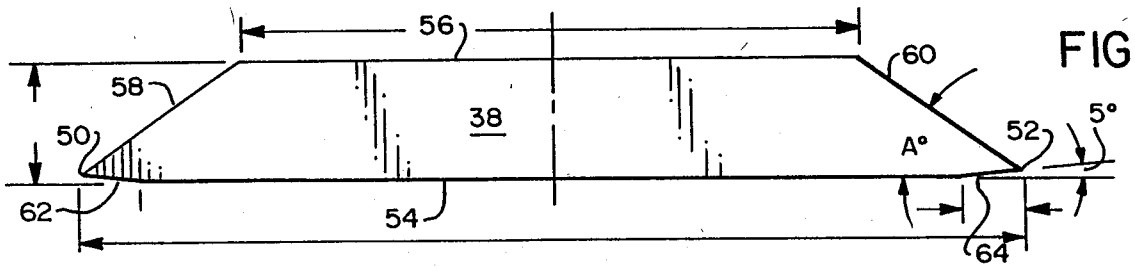
FIG. 3 is a cross-sectional view of a reversible blade of the preferred embodiment.

The knife blade 38, as shown in FIG. 3, should have a uniform trapezoidal cross section. In a preferred embodiment two such blades 38 are disposed end-to-end to extend the length of the cassette 40. The blades 38 are symmetrical about a center line as shown in FIG. 3, with the first cutting edge 50 and an opposite cutting edge 52. The blade has a substantially flat base surface 54, which is preferably about two inches across from the edge 50 to the edge 52. There is a flat top surface 56 on the order of about one-and-one-quarter inches across and a pair of tapered surfaces 58 and 60 which slope downwards to the edges 50 and 52, respectively. The bottom and top surfaces 54,56 define the blade thickness or width. The blade angles A, depending on the desired chip size, can preferably be about thirty to forty-five degrees. Blades can be ground to half-degree increments. There also are regrind surfaces 62 and 64, at the flat base surface 54 extending inward about one-eighth inch from each of the edges 50 and 52, respectively. These surfaces form a minor angle, such as about five degrees, with the base 54, and permit a limited number of re-sharpenings of the knife blade 38, depending on the condition of the edge 50 or 52. If the knife is badly nicked, or if the knife has contacted or scraped the bedknife, the blade 38 can be discarded.

Figure 5:
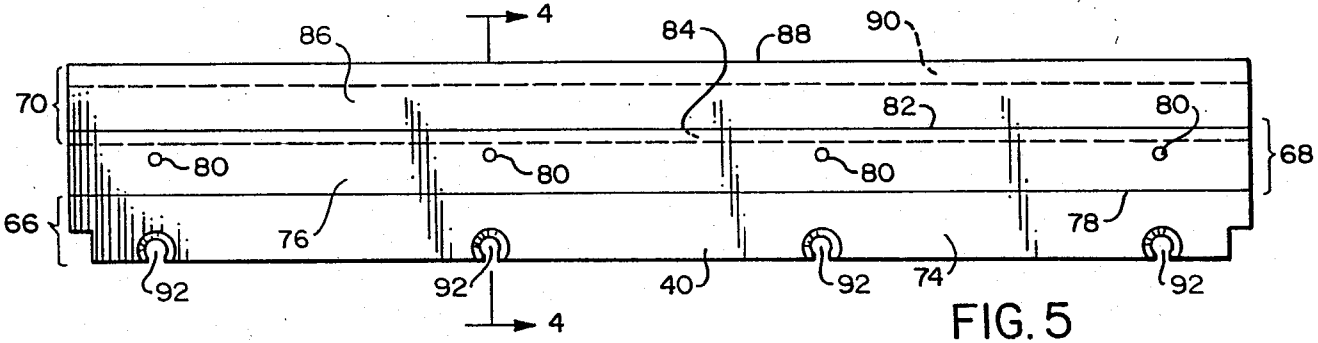
FIGS. 4 and 5 are cross sectional and top plan views respectively, of the knife cassette of the preferred embodiment.
Figure 4:
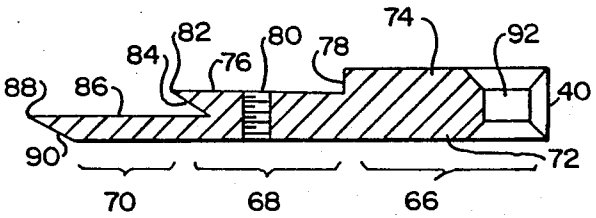

As shown in FIGS. 4 and 5, the cassette 40 has a profiled cross-section formed of progressively recessed regions or sections, beginning with a proximal section 66, an intermediate section 68, and a distal or tip section 70. The cassette 40 has a flat lower surface 72 extending for the three regions. A top surface 74 of the proximal section 66 defines a predetermined width of the knife assembly 16. At the intermediate section, there is a recessed knife holder support surface 76 which extends distally from a shoulder or step-down 78. There are a plurality of threaded openings 80 in the intermediate section 68 for receiving the blade holder retaining screws 44. Sloping down and proximally from a distal edge of the blade holder support surface 76 an undercut surface 84 forms an angle of about thirty degrees, extending to a blade support surface 86 of the distal or tip section 70. This surface extends distally. At a tip or distal edge 88 of the cassette 40, a sloping surface 90 extends proximally and downward to the flat lower surface 72. This sloping surface 90 is subjected to wear from the wood chips cut by the blade 38. Accordingly, at least this surface 90 should be coated with an anti-abrasive material, such as electroless nickel.

Finally, at a proximal edge of the cassette 40 there are several open bores 92 which permit flowing of babbitt for forming babbitt shims thereon.

Figure 6:
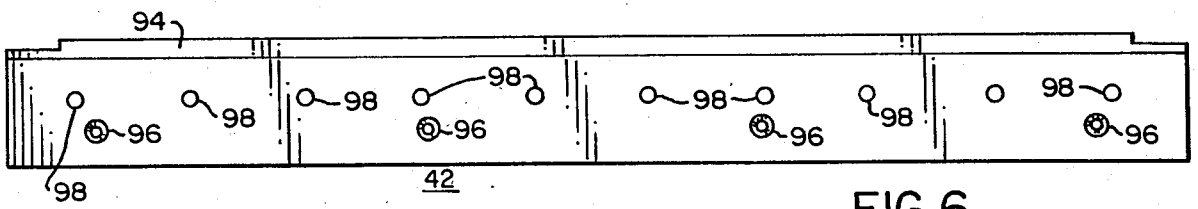
FIG. 6 is a top plan view of the knife holder of the preferred embodiment.

As shown in FIG. 6, the blade holder 42 is formed generally as a flat plate having a tapered distal surface 94 and a number of countersunk bores 96 to accommodate the blade holder retaining screws 44. There are also a number of aligned, evenly spaced through-bores 98 which are disposed over the position of the forward or distal edge 82 of the blade holder support surface 76 of the cassette 40. In a preferred embodiment, these through-bores 98 are evenly spaced, with a two to three inch nominal spacing therebetween. The blade assembly 16 is assembled with the blade 38 held in place on the cassette 40, and so that the concealed tapered surface 60 faces the sloping surface 84. Molten babbitt is flowed in through the through-bores 98 so that the blade 38 is firmly seated by means of babbitt shims 46 against the sloping surface 84. Thus, the blade support surface 86 and the sloping surface 84 serve as an underlying plate and a back-up plate, respectively, for the reversible double-edged blade. Either of the two surfaces 58 or 60 that is not exposed to the feed material thus serves as a support for the blade 83 within the cassette 40. The use of babbitt shims permits the surfaces 60 and 84 to be brought into precise contact to permit critical adjustment of the amount of knife projection, even if the blade has been sharpened. Also, babbitt shims can be formed at the proximal edge of the cassette 40 by flowing molten babbitt into the bores 92. This achieves positioning adjustment of the assembly 16 relative to the heel 32 of the stationary knife holder 14.

The assembly and operation of the knife assemblies 16 into the disk 10 is quite straightforward. The knife assemblies can be removed from the disk 10 in the same fashion as single-edge resharpenable blades. The blade holder 42 can be unscrewed and removed from the cassette, and the blade 38 removed and sharpened or discarded, as appropriate. The cassette is placed into a knife mold or jig (not shown) and a pair of gauge-checked blades 38 of the appropriate grind angle are placed end-to-end into the cassette 40 with their base surface 54 against the blade support surface 86 and with one of the two sloping surfaces 58,60 facing against the undercut sloping surface 84. The blade position is adjusted for the appropriate amount of projection, and the top blade holder 42 is fastened in place. Molten babbitt is now flowed into the through-bores 98 in the holder 42. Babbitt is poured into alternate holes first, and then into the remaining holes, so that heat builds up uniformly within the assembly 16. Once the babbitt metal is set, the cassette assembly can be removed from the knife molds, and the latter can be used for setting and babbitting the next knife assembly 16. Finally, any babbitt can be removed which projects above the top knife holder 42.

Figure 7:
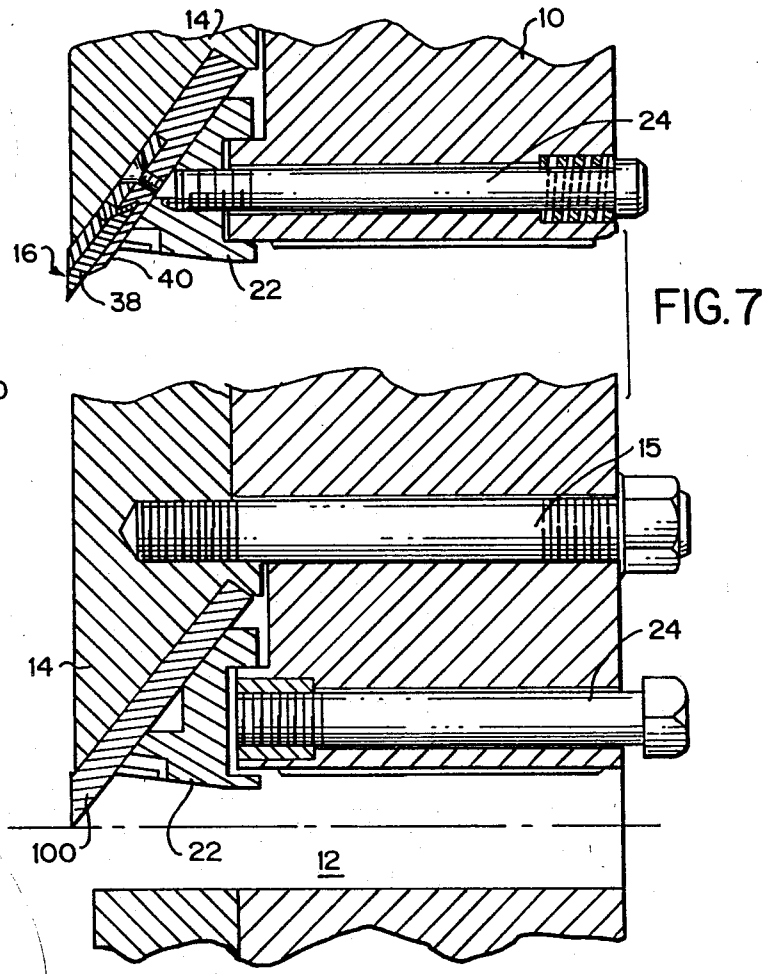
FIG. 7 is a sectional view of a portion of a chipper disk similar to FIG. 2, illustrating interchangeability of the cassette-type knife assemblies of this invention with standard single-edge regrindable blades.

As shown in FIG. 7, the cassette-type knife assembly 16 of this invention can be interchanged with a regrindable single-edge blade 100 of the conventional type. While it is preferred that only cassette knife assemblies 16 or only regrindable single-edge knives 100 be employed within a given chipper, the two types of blades are shown at adjacent cutting stations 13, simply for purposes of illustration. Elements that also appear in the previously described views are identified with the same reference numbers, and a detailed description is omitted. The cassette-type knife assemblies 16 of this invention can be used to upgrade an existing disk-type cutter by replacing the single-edge regrindable blades 100, without necessitating a refitting of the blade holders 14, 22 or the like.

Figure 8:
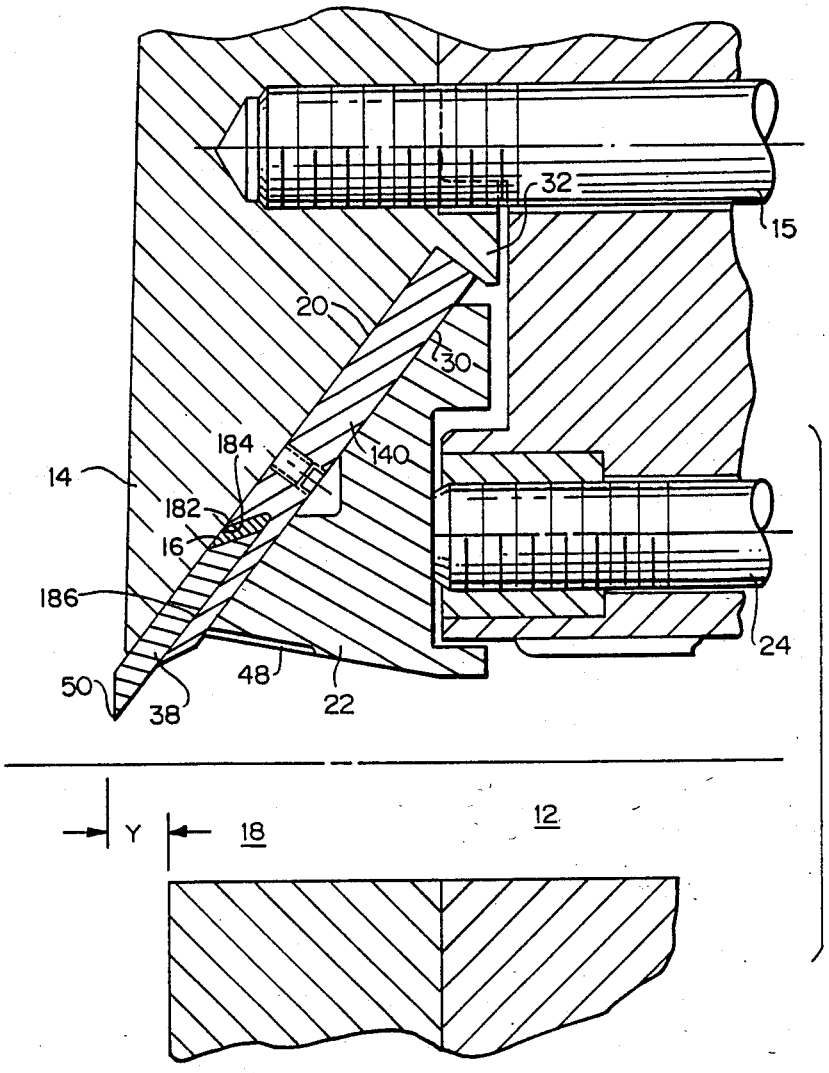
FIGS. 8, 9 and 10 are sectional views of a portion of a chipper disk illustrating knife assemblies according to respective alternative embodiments of this invention.

FIG. 8 shows one alternative embodiment which is similar in significant aspects to the above-described embodiment, but omits the blade holder 42, which is required only for babbitting, and is removed for installation. Here parts which are identical with those in the previous embodiment are identified with the same reference numbers, and their detailed description need not be repeated. Here, a cassette 140 has a uniform thickness from its proximal edge to an edge 182 from which a proximally sloping wall or land 184 extends to a blade support surface 186.

For babbitting purposes, the same steps are carried out as mentioned above, and the blade 38 is positioned into the cassette 140 as described, with a blade holder 42 installed thereon to position the blade for babbitting. However, after babbitting is completed, the blade holder 42 is removed, and the blade assembly is installed with the blade 38 being sandwiched in place between the upper clamping surface 20 of the fixed blade holder 14 and the blade holder surface 186 of the cassette 140. When the blade edge 50 becomes worn, the clamping member 22 can be loosened and the blade 38 withdrawn and reseated against the babbitt shims 146 with the fresh blade edge exposed and the worn edge 50 against the shims 146. Then the clamping member 22 can be retightened. Because the blade is keyless, it can be slid out for reversing without having to remove the associated cassette.

Figure 9:
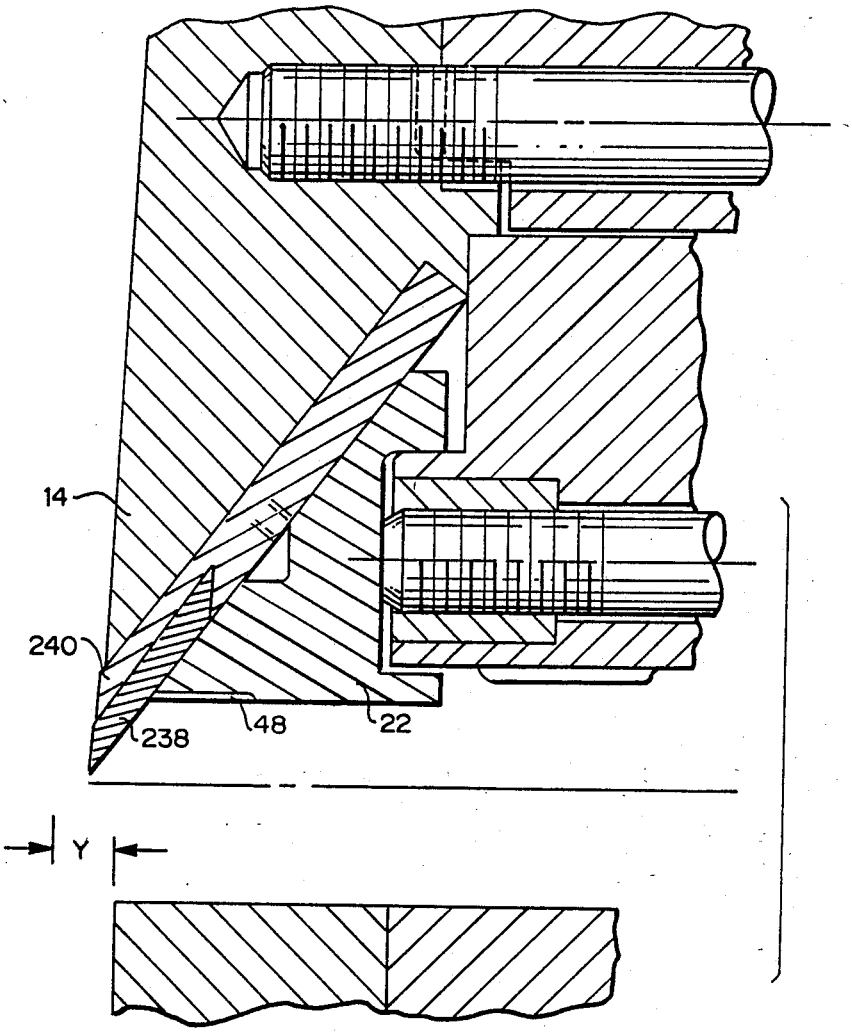

FIG. 9 shows another alternative embodiment, in which similar parts are identified with the same reference numbers as previously. This embodiment of the knife assembly employs a parallelogram cross section blade 238 and a suitably profiled cassette 240. Here the cassette 240 is basically a mirror image of the cassette 140 of FIG. 8. A principal difference is that the cassette 240 and blade 238 are oriented reversely to the orientation of FIG. 8, but the principles of construction and installation are similar.

Figure 10:
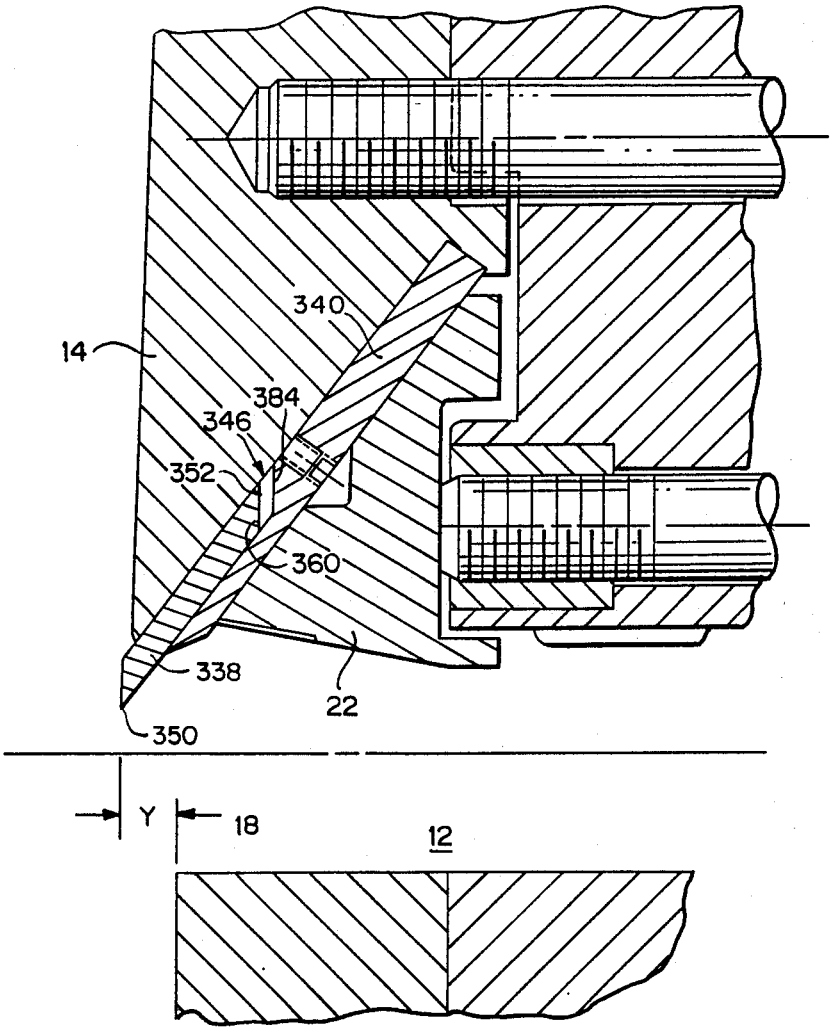

FIG. 10 shows still another possible embodiment, again employing a parallelogram-cross-section blade, and in which the same parts employed previously are identified with the same reference numbers. This structure is similar to that of FIG. 8, and its employment and installation techniques are also similar. Here the blade 338 and cassette 340 are clamped between the fixed blade holder 14 and the clamping member 22, oriented as in FIG. 8. The cassette 340 has a distally sloping tapered surface 384 to face the concealed edge 352 of the blade 338, and a babbitt shim 346 is formed between the tapered blade surface 360 and the cassette tapered surface 384.

While this invention has been described with respect to a preferred embodiment, it should be understood that this invention is not limited to that precise embodiment, rather many modifications and variations would present themselves to those skilled in the art without departing from the scope and spirit of this invention, as defined in the appended claims.

What is claimed is:

1. A chipper knife assembly for a chipper device of the type having a plurality of such knife assemblies radially disposed on a front face of a rotary disk, each blade assembly being adjacent to a chip slot that passes axially through the disk; each said knife assembly comprising at least one flat, double-edged knife blade of generally trapezoidal cross section, having a flat base surface of a predetermined breadth, a top surface spaced a predetermined distance from said base surface to define a width of the knife blade, and first and second tapered sides that slope downward from said top surface to the base defining first and second cutting edges of the blade; an elongated cassette of sufficient length to accommodate at least one said knife blade and having in cross section a proximal section, an intermediate section, and a distal section, the cassette having a flat lower surface, said proximal section having an upper surface spaced a predetermined cassette width from the lower surface; said intermediate section having a blade holder support surface recessed from said proximal section upper surface to define a shoulder at a proximal edge of the intermediate section, and a tapered surface sloping proximally partway towards said base surface from a distal edge of said blade holder support surface; and said distal section having a blade support surface on which rests the base surface of said knife blade and extending from said tapered surface to a distal edge of the cassette, and a wear surface that slopes proximally from said distal edge to said lower surface of the cassette; said blade being positioned on said blade support surface with its first tapered side facing said tapered surface and its second edge projecting beyond said distal edge of said cassette; a blade holder in the form of a laterally elongated plate having a predetermined breadth to extend from said shoulder over said blade holder support surface and continuing over a substantial portion of the upper surface of said knife blade to adjacent a distal edge of the blade upper surface; means for clamping said blade holder in place onto said cassette with said blade sandwiched therebetween; and said blade holder being provided with a plurality of passages therethrough at a position substantially over the distal edge of said blade holder support surface to permit flowing of molten babbitt into a space between the first tapered surface of said blade and the tapered surface of said cassette.

2. The knife assembly of claim 1 wherein said means for clamping comprises a plurality of threaded fasteners, a plurality of threaded openings in said cassette on said blade holder support surface, and a plurality of openings in said blade holder which register with the threaded openings in said cassette.

3. The knife assembly of claim 1 wherein said wear surface at said distal edge of said cassette includes a layer of a high wear resistant material.

4. The knife blade assembly of claim 3 wherein said layer on said wear surface is a plating of electroless nickel.

5. The knife assembly of claim 1 wherein said blade surface has regrindable regions adjacent said cutting edges and forming an angle on the order of about five degrees with respect to the remainder of said base surface.

6. The knife assembly of claim 1 wherein said plurality of passages include a series of openings evenly spaced at intervals over the length of said blade holder.

7. A chipper knife assembly for a chipper device of the type having a plurality of such knife assemblies radially disposed on a front face of a rotary disk, each blade assembly being adjacent to a chip slot that passes axially through the disk; each said knife assembly comprising at least one flat, double-edged knife blade of generally non-rectangular quadrilateral cross section, having a flat base surface of a predetermined breadth, a top surface spaced a predetermined distance from said base surface to define a width of the knife blade, and first and second tapered sides that slope downward from said top surface to the base defining first and second cutting edges of the blade; an elongated cassette of sufficient length to accommodate at least one said knife blade and having in cross section a proximal section, an intermediate section, and a distal section, the cassette having a flat lower surface, said proximal section having an upper surface spaced a predetermined cassette width from the lower surface; said intermediate section having a blade holder support surface; a tapered surface sloping partway towards said base surface from a distal edge of said blade holder support surface; and said distal section having a blade support surface on which rests the base surface of said knife blade and extending from said tapered surface to a distal edge of the cassette, and a wear surface that slopes proximally from said distal edge to said lower surface of the cassette; said blade being positioned on said blade support surface with its first tapered side facing the cassette tapered surface and its second edge projecting beyond said distal edge of said cassette; a blade holder in the form of a laterally elongated plate having a predetermined breadth to extend over said blade holder support surface and continuing over a substantial portion of the upper surface of said knife blade to adjacent a distal edge of the blade upper surface; means for clamping said blade holder in place onto said cassette with said blade sandwiched therebetween; and said blade holder being provided with a plurality of passages therethrough at a position substantially over the distal edge of said blade holder support surface to permit flowing of molten babbitt into a space between the first tapered surface of said blade and the tapered surface of said cassette.

8. The knife assembly of claim 7 wherein said blade holder support surface and said proximal section upper surface are substantially coplanar, and wherein said blade holder is removed after said babbitt has been flowed into the space between the cassette tapered surface and the blade first tapered surface.

9. The knife assembly of claim 7, wherein said blade is of parallelogram cross section.

10. The knife assembly of claim 7 wherein said blade is of trapezoidal cross section.

11. The knife assembly of claim 7 wherein said cassette tapered surface slopes proximally downward to define an undercut surface.

12. The knife assembly of claim 7 wherein said cassette tapered surface slopes distally downward.

* * * * *